US006026819A

United States Patent [19]

Berger

[11] Patent Number: 6,026,819

[45] Date of Patent: Feb. 22, 2000

[54] TOBACCO SMOKE FILTER INCORPORATING SHEATH-CORE BICOMPONENT FIBERS AND TOBACCO SMOKE PRODUCT MADE THEREFROM

[75] Inventor: Richard M. Berger, Midlothian, Va.

[73] Assignee: Filtrona International Limited, Harpenden, United Kingdom

[21] Appl. No.: 09/025,301

[22] Filed: Feb. 18, 1998

[51] Int. Cl.[7] ..... A24D 3/06; A24D 3/08

[52] U.S. Cl. ..... 131/332; 131/341; 131/342; 131/343; 264/173.16

[58] Field of Search ..... 131/331, 332, 131/335, 341, 342, 343, 344; 428/174, 222, 304.4, 311.11, 311.51, 319.3; 264/173.16

[56] References Cited

U.S. PATENT DOCUMENTS

| | | | |
|---|---|---|---|
| 3,097,991 | 7/1963 | Miller et al. . | |
| 3,112,160 | 11/1963 | Rush . | |
| 3,176,345 | 4/1965 | Powell . | |
| 3,192,562 | 7/1965 | Powell . | |
| 3,276,944 | 10/1966 | Levy . | |
| 3,355,520 | 11/1967 | Maloney et al. . | |
| 3,377,220 | 4/1968 | Berger et al. . | |
| 3,474,051 | 10/1969 | Chappelear et al. . | |
| 3,595,245 | 7/1971 | Buntin et al. . | |
| 3,615,995 | 10/1971 | Buntin et al. . | |
| 3,637,447 | 1/1972 | Berger . | |
| 3,825,379 | 7/1974 | Lohkamp et al. . | |
| 3,856,025 | 12/1974 | Sato | 131/264 |
| 3,972,759 | 8/1976 | Buntin . | |
| 4,107,243 | 8/1978 | Stearns et al. . | |
| 4,173,504 | 11/1979 | Tomioka et al. . | |
| 4,189,338 | 2/1980 | Ejima et al. . | |
| 4,260,565 | 4/1981 | D'Amico et al. . | |
| 4,355,995 | 10/1982 | Berger . | |
| 4,380,570 | 4/1983 | Schwarz . | |
| 4,406,850 | 9/1983 | Hilis . | |
| 4,422,266 | 12/1983 | Brody . | |
| 4,442,057 | 4/1984 | Brody . | |
| 4,518,744 | 5/1985 | Brody . | |
| 4,522,884 | 6/1985 | Brody . | |
| 4,632,861 | 12/1986 | Vassilatos . | |
| 4,634,739 | 1/1987 | Vassilatos . | |
| 4,731,215 | 3/1988 | Schwarz . | |
| 4,795,688 | 1/1989 | Misumi et al. . | |
| 4,869,275 | 9/1989 | Berger . | |
| 5,509,430 | 4/1996 | Berger . | |
| 5,607,766 | 3/1997 | Berger . | |
| 5,620,641 | 4/1997 | Berger . | |
| 5,633,082 | 5/1997 | Berger . | |

*Primary Examiner*—Stanley S. Silverman
*Assistant Examiner*—Steven B. Leavitt
*Attorney, Agent, or Firm*—Jacobson, Price, Holman & Stern, PLLC

[57] ABSTRACT

Bicomponent fibers comprising a core of a thermoplastic material, preferably polypropylene, and a sheath of a blend of the core-forming polymer and an ethylene-vinyl acetate copolymer are used to produce tobacco smoke filter elements which may be incorporated into tobacco smoke filter products such as filtered cigarettes. The addition of significant quantities of the core-forming material to the ethylene-vinyl acetate used to form the sheath avoids problems experienced heretofore in build-up of polymer in the forming dies using conventional filter-forming equipment. Additionally, the blended sheath-forming polymer improves adhesion between the sheath and the core of the bicomponent fiber and, with the use of polypropylene, improves the hardness of the resultant tobacco smoke filter elements.

21 Claims, 3 Drawing Sheets

TOBACCO SMOKE FILTER INCORPORATING SHEATH-CORE BICOMPONENT FIBERS AND TOBACCO SMOKE PRODUCT MADE THEREFROM

This invention relates to unique polymeric bicomponent fibers and to the production of tobacco smoke filters incorporating such fibers as the primary constituent and tobacco smoke products such as filtered cigarettes including at least one such filter element.

BACKGROUND OF THE INVENTION

A wide variety of fibrous materials have been employed in the production of tobacco smoke filter elements, particularly for filtered cigarettes and the like. The choice of such materials has been limited because of the need to balance various commercial requirements. A very important property of a tobacco smoke filter is obviously its filtration efficiency, i.e., its ability to remove selected constituents from the tobacco smoke. While there is no commercially acceptable retention level, the typical range is 35–60% total particulate matter. The range of filtration efficiency has often had to be comprised in order to satisfy other commercially important factors, such as resistance to draw, hardness, impact on taste and manufacturing ease and expense. For example, sometimes retention levels of 70% and higher are required; in such instances, the firmness of the filter often becomes the limiting factor. As fibers get smaller to provide higher retention, the filter elements become softer.

Cellulose acetate has long been considered the material of choice in the production of tobacco smoke filters, primarily because of its ability to provide commercially acceptable filtration efficiency, on the order of about 50%, low resistance to draw, and acceptable filter hardness without significantly detracting from the tobacco taste desired by the majority of smokers. Yet, tobacco smoke filter elements incorporating fibers comprising homopolymers of cellulose acetate have numerous limitations and disadvantages.

U.S. Pat. No. 5,509,430 issued Apr. 23, 1996 (the '430 patent), the subject matter of which is incorporated herein in its entirety by reference, is directed to the production of tobacco smoke filters comprising sheath-core bicomponent fibers with the core being a low-cost, high strength, thermoplastic material, preferably polypropylene, completely covered with a sheath formed of plasticized cellulose acetate, ethylene vinyl acetate copolymer, polyvinyl alcohol or ethylene-vinyl alcohol copolymer. Each of these sheath-forming materials provides commercially acceptable taste in tobacco smoke products. Yet, the core-forming thermolastic polymer affords the smoke-permeable matrix with significant strength so that the thickness of the more expensive sheath-forming material is limited and the cost of the product is dramatically reduced. Filter elements formed from each of the specific bicomponent fiber embodiments referred therein have unique and advantageous properties, particularly when incorporated into tobacco smoke filter products such as filtered cigarettes.

Among the various sheath-forming materials discussed in the '430 patent, an ethylene-vinyl acetate copolymer has been found to be especially useful in the production of filtered cigarettes and the like because of the highly desirable taste properties of ethylene-vinyl acetate when contacted by tobacco smoke. However, problems have been encountered in attempting to commercially process bicomponent fibers having a sheath formed entirely of ethylene-vinyl acetate copolymer. Normally, a multiplicity of fibers are subjected to a treatment with steam and then contacted with cooling air to bond the fibers at their points of contact to form a continuous rod defining a tortuous interstitial path for passage of smoke when the rod is subdivided into tobacco smoke filter plugs to be incorporated into filtered cigarettes or the like. The ethylene-vinyl acetate copolymer sheath material of such bicomponent fibers tends to stick in conventional commercial rod-forming dies. In order to deal with this problem, it was necessary to develop modified equipment utilizing an application of indirect steam which minimized the undesirable build-up of polymer in the die. Unfortunately, with such equipment, lower machine speeds were required and unsatisfactory bonding was still experienced.

In addition to the manufacturing problems encountered with processing bicomponent fibers having an ethylene-vinyl acetate copolymer sheath and a thermoplastic polymeric core such as polypropylene, poor adhesion between the sheath- and core-forming materials resulted in polymer separation at the interface. A wide range of ethylene-vinyl acetate polymers and copolymers and related materials were tested, but in each instance materials that provided satisfactory sheath-core bonding created a sticking problem in the die.

Tobacco smoke filter elements formed from bicomponent fibers with a sheath of ethylene-vinyl acetate copolymer were also found to be less firm or hard than filters formed from standard cellulose acetate fibers. While there is no commercially acceptable hardness level, the 180 minimum hardness stated in U.S. Pat. No. 3,377,220, the subject matter of which is incorporated herein by reference, is desirable, although commercial cellulose acetate filter elements having a hardness in the 160 range are in the market. Softer filter elements provide a different feel to the smoker. In extreme instances, a smoker's lips can tend to collapse the filter plug, reducing the permeability of the matrix and increasing the resistance to draw smoke through the filter element. Reduced hardness also causes problems in the processing of such elements by the high speed filtered cigarette manufacturing equipment commercially in use.

SUMMARY OF THE INVENTION

It is a primary object of this invention to provide unique ethylene-vinyl acetate containing sheath/thermoplastic core polymeric bicomponent fibers, tobacco smoke filter elements formed from such fibers, and tobacco smoke filter products incorporating such elements, which overcome all of the foregoing disadvantages of ethylene-vinyl acetate copolymer/thermoplastic bicomponent fibers made according to the '430 patent. The improved bicomponent fiber of this invention includes a sheath-forming material which is a blend of an ethylene-vinyl acetate copolymer with a significant proportion of the core-forming material, preferably polypropylene, a composition that overcomes the aforementioned processing difficulties and can be used in the high speed production of tobacco smoke filter elements and tobacco smoke filter products that meet or exceed all of the commercially important properties.

A further object of this invention is to provide a bicomponent fiber which can be bonded in conventional steam forming equipment at high production speeds for the formation of tobacco smoke filter rods which may be subsequently subdivided into discrete tobacco smoke filter elements for incorporation into tobacco smoke filter products such as filtered cigarettes and the like.

Yet another object of this invention is the provision of a sheath-core bicomponent fiber material, particularly for use in the production of tobacco smoke filter elements, which combines the commercially desirable taste, hardness and resistance to draw properties of cellulose acetate fiber filters with a low cost, high strength, polymeric core material, such as polypropylene, encased in a blended polymeric sheath comprising significant quantities of the core-forming polymer admixed with ethylene-vinyl acetate copolymer. The ethylene-vinyl acetate in the sheath affords tobacco smoke filter products incorporating such bicomponent fibers with the taste properties desired by most smokers, while the core-forming material blended into the sheath-forming material improves the strength of the product, the bond between the sheath and the core, and facilitates the high speed production of bonded smoke-permeable rods of such fibers in commercially available standard processing equipment without sticking.

Still another object of the invention is the provision of filter rods, filter elements, and filtered cigarettes and the like incorporating at least one filter element made from bicomponent fibers comprising a core of polypropylene encompassed by a sheath of a blend of polypropylene and ethylene-vinyl acetate copolymer with improved hardness, enhanced by perhaps 20% as compared to tobacco smoke filter elements made from bicomponent fibers wherein the sheath is substantially entirely formed of ethylene-vinyl acetate copolymer in the manner described in the '430 patent. With the use of the instant inventive concepts firmer filters can be produced with finer fibers, enabling the production of higher retention levels without sacrificing other important properties.

Further objects and advantages of the instant invention will become apparent to those skilled in the art from the accompanying drawings and detailed description of the preferred embodiments.

DETAILED DESCRIPTION OF THE PREFERRED EMBODIMENTS

Figure 1:
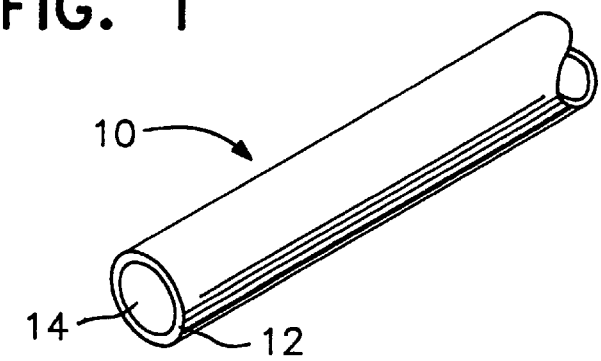
FIG. 1 is an enlarged schematic perspective view of a portion of a sheath-core bicomponent fiber according to the instant invention.

The instant inventive concepts are embodied in a bicomponent, sheath-core, preferably melt-blown, fiber where the core is a low cost, low shrinkage, high strength, thermoplastic polymer, preferably polypropylene, and the sheath is a blend of the core-forming material with an ethylene-vinyl acetate copolymer.

The method of manufacturing the specific polymers used in the production of the bicomponent fibers is not part of the instant invention. Processes for making these polymers are well-known and most commercially available thermoplastic core-forming materials and sheath-formed copolymers of ethylene-vinyl acetate can be blended according to this invention. Though it is not critical that the modifying polymer blended with the ethylene-vinyl acetate copolymer to produce the sheath-forming material be identical in all respects to the core-forming material, for all practical purposes, they must be the same basic polymer, e.g., polypropylene, to ensure good bonding and capability in the melt extrusion process through the bicomponent die. Different grades of the same polymer may be used to provide particular properties in different parts of the fiber. For example, one type of polypropylene may provide higher strength when used as the core-forming material, whereas a different grade of polypropylene may be better suited for blending with the ethylene-vinyl acetate in forming the sheath. Providing sheath- and core-forming materials with properties to enhance the blending of the sheath-core components is not a significant problem to those skilled in the art with commercially available polymers.

Additionally, while reference is made, for example, in the preferred embodiment, to a core formed of polypropylene and a sheath formed of a blend of ethylene-vinyl acetate copolymer and polypropylene, additives may be incorporated or compounded into the core-forming material and/or the sheath-forming material to provide the bicomponent fibers produced therefrom with unique properties, e.g., increased hydrophilicity, or even increased hydrophobicity.

Polypropylene is highly preferred as the core-forming material and sheath-modifying additive because this polymer is known to be relatively inexpensive and easily processed. Moreover, polypropylene provides the bicomponent fibers with excellent strength, a property which is particularly important in the production of very fine fibers using melt-blown techniques, the filters formed therefrom having improved hardness. Various modified polypropylenes can be used as the core-forming material and sheath-modifying additive to achieve even better adhesion between the core and the sheath, such as Dupont's BUINEL CXA series 5000 anhydride-modified polypropylenes, other anhydride (preferably maleic acid and hydride) polypropylenes, and hydride functionalized polypropylenes, adhesive polypropylenes such as Quantum Chemical Corporation's PLEXAR extrudable adhesive polypropylenes, or other reactive polypropylenes.

The melt flow index of the sheath modifier is an important property. Ideally the melt flow of the sheath additive and the melt flow of the core-forming polymer are identical, but they can vary somewhat. For fiber spinning, the melt flow can range from 5 to 50; for melt blown fibers, melt flow indices of 100 to 1000 are more appropriate.

Likewise, the specific nature of the ethylene-vinyl acetate copolymers may vary so long as the level of ethylene-vinyl acetate present in the sheath-forming polymeric blend is adequate to impart taste properties which are important in the use of these bicomponent fibers in the production of tobacco smoke filters for filtered cigarettes and the like. Generally, these polymers are made by copolymerization of vinyl acetate and a monomer such as ethylene. Low molecular weight resins are particularly adapted to the production of small diameter bicomponent fibers and, in some cases, plasticizer may be added to lower viscosity. The melt viscosity of the copolymer may be modified by changing the molecular weight of the ethylene-vinyl acetate polymer through the polymerization process. Also, the percentage of ethylene-vinyl acetate copolymer in the sheath-forming material can be selected to provide the required level of ethylene-vinyl acetate in the sheath for commercially acceptable taste properties in filtered elements formed from these fibers. For example, although the preferred ethylene-vinyl acetate copolymer for this invention comprises 28% ethylene-vinyl acetate, other mixtures can be utilized, e.g., an 18% ethylene-vinyl acetate copolymer. With the higher ethylene-vinyl acetate copolymers, the percentage of polypropylene in the sheath-forming blend may be increased without reducing the taste afforded by the ethylene-vinyl acetate in the sheath. Those skilled in the art can readily select the appropriate parameters to produce a fiber of the desired size and properties within the scope of the instant inventive concepts.

Although it is possible that other thermoplastic polymers may be utilized as the core-forming material and sheath-modifying additive, it is noted that polypropylene and ethylene-vinyl acetate copolymer form an anisotropic mixture in the melt with the polypropylene forming discrete elongated globules or "streaks" in the ethylene-vinyl acetate copolymer. It is believed that the polypropylene is randomly dispersed in the sheath and does not migrate into any particular concentration area. No significant surface modification of the fiber is recognized, e.g., there appears to be no roughness in the fiber surface. Fibers formed entirely of such blends would have limited utility because of their very low strength; however, bicomponent fibers utilizing the blended polymer as a sheath encompassing a polypropylene core provide the mechanical characteristics of the ethylene-vinyl acetate copolymer to improve fiber processability (i.e., to virtually eliminate sticking in the forming dies) while maintaining satisfactory interstitial bonding using commercially acceptable steam treating techniques to produce substantially self-sustaining, smoke permeable rods therefrom. The use of polypropylene in the core produces a stiffer fiber which adds structural strength to the matrix.

The use of polyethylene as the core-forming material and the sheath-modifying additive, rather than polypropylene, is found to minimize the aforementioned die-sticking problems, but does not produce equivalent results in enhancing the hardness of filters produced from such fibers. Since ethylene-vinyl acetate copolymers are predominantly formed of polyethylene, it is believed that polyethylene will tend to blend homogeneously with the ethylene-vinyl acetate copolymer when used as a sheath-modifying additive, thereby producing more of a solution in the melt than an emulsion as with polypropylene. The "blobs" of polypropylene in the sheath are found to reduce adherence of the polymer to the tooling better than polyethylene, although polyethylene-modified sheath-forming ethylene-vinyl acetate blends, do improve the processability of ethylene-vinyl acetate sheath bicomponent fibers. Moreover, the use of a polyethylene, whether the polyethylene be high pressure or low pressure polyethylene, as a core-forming material diminishes the stiffness of such fibers for the production of tobacco smoke filter elements, although high pressure polyethylene is better in this respect than low pressure polyethylene.

The instant inventive concepts apply to bicomponent fibers, wherein the core is a thermoplastic such a polypropylene and the sheath comprises an ethylene-vinyl acetate copolymer, regardless of the method used to produce the fibers. Applicable fiber forming methodology would principally be melt spinning, melt blowing, and/or spun bonded processes with the fibers collected in the form of yarn, rovings or webs.

Since the preferred core-forming polymer and sheath-modifying additive is polypropylene, the following detailed description and exemplary data will be directed to this embodiment of the instant inventive concepts.

Reference is now made generally to the drawings, and more particularly to FIG. 1, wherein a bicomponent fiber according to the preferred embodiments of the instant inventive concepts is schematically shown at 10. Of course, the size of the fiber and the relative proportions of the sheath-core portions thereof have been greatly exaggerated for illustrative quality. Fiber 10 is preferably comprised of a blended ethylene-vinyl acetate copolymer/polypropylene sheath 12 and a polypropylene core 14. The core material comprises at least about 30%, and up to about 90% by weight of the overall fiber content, but for practical purposes at least 30% of the bicomponent fiber will be provided in the sheath to ensure that the polypropylene core is totally encompassed by the sheath-forming material during the extrusion process.

Although the bicomponent fiber 10 shown in FIG. 1 is cylindrical in cross-section, it is well known that filtration efficiency will increase with increased surface area. Thus, if desired, bicomponent fibers of this invention may be extruded through dies which form a non-circular fiber cross-section, e.g., a trilobular or "Y"-shaped fiber, or other multi-branched cross-sections such as "X"- or "H"- shapes (not shown). Techniques for the production of such non-round fibers are well known and described, for example, in the '430 patent.

The use of a non-round cross-section not only increases the surface area of the bicomponent fibers to provide improved filtration in an ultimate tobacco smoke filter, but bicomponent fibers of such configurations enhance the use of air when melt-blowing techniques are used for attenuation of the fiber as also described in some detail in the '430 patent and as discussed hereinbelow. The ability to melt-blow bicomponent fibers of the instant invention enables the production of very fine fibers, on the order of less than 10 microns, down to even 1 to 3 microns in average diameter. Such fine fiber sizes contribute increased surface area in tobacco smoke filter elements formed therefrom resulting in enhanced retention of undesirable components in smoke passing through such filter elements and increased pressure drop, with less weight.

The use of bicomponent fibers, including melt-blown bicomponent fibers, in the production of tobacco smoke filter elements for use in the tobacco smoke filter products such as filtered cigarettes is shown in various patents and applications in the name of the inventor hereof, Richard M. Berger. In addition to the '430 patent referred to previously, the subject matter of Berger U.S. Pat. Nos. 5,607,766 issued Mar. 4, 1997; 5,633,082 issued May 27, 1997; and 5,620,641 issued Apr. 15, 1997, as well as Berger copending U.S. application Ser. No. 08/1850,006 filed May 1, 1997, are also incorporated herein in their entirety by reference.

Figure 2:
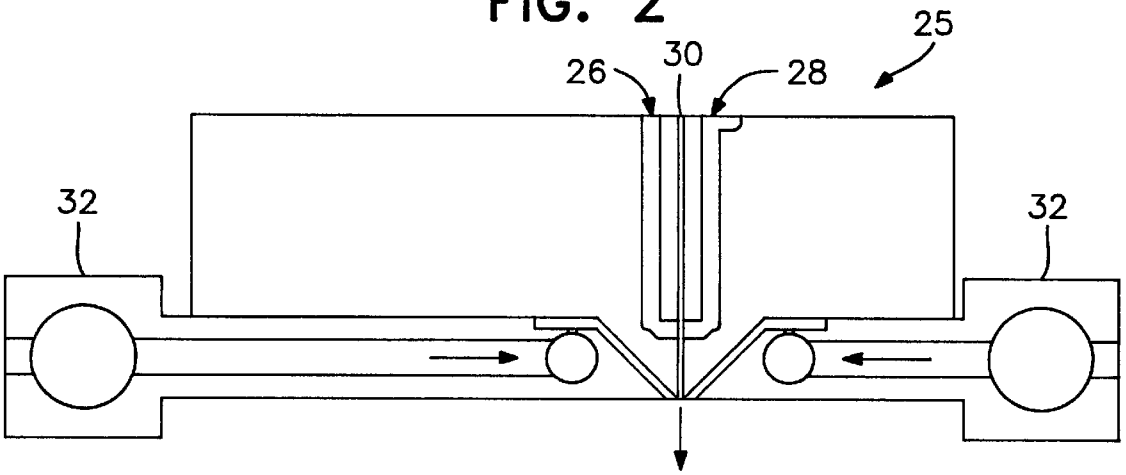
FIG. 2 is a schematic view of one form of melt-blowing die that may be used for extruding and attenuating bicomponent fibers according to this invention.
Figure 3:
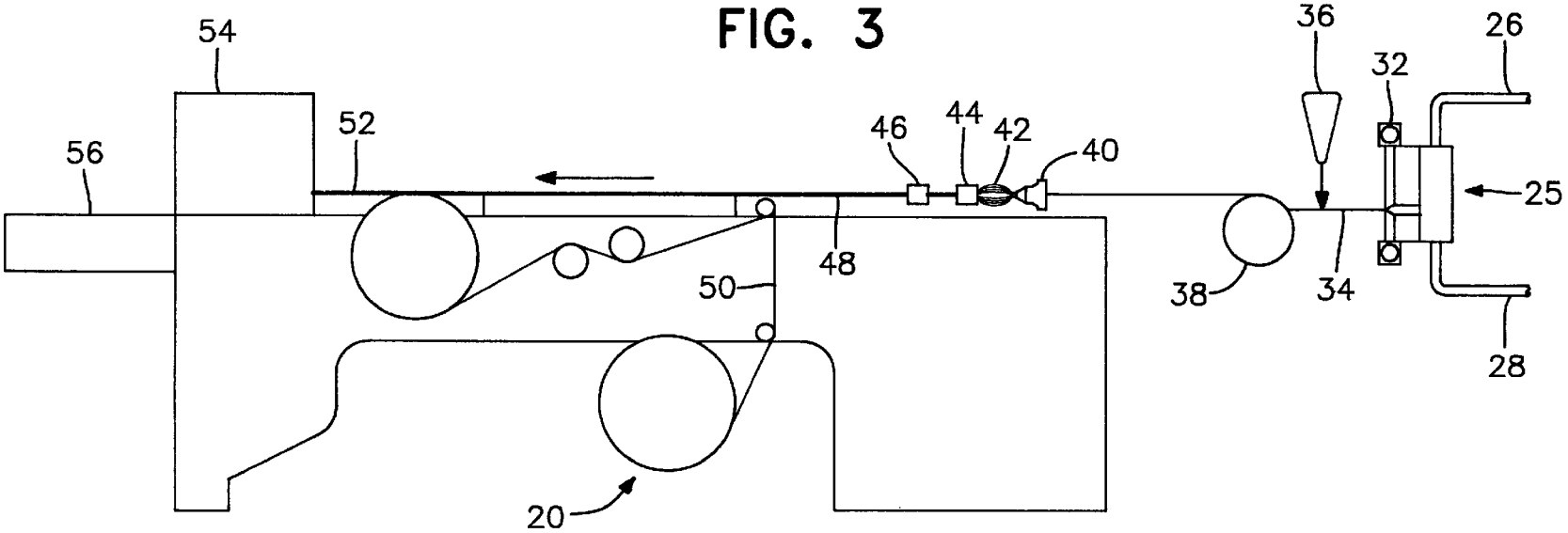
FIG. 3 is a schematic view of one form of a process line for producing bicomponent fibers and tobacco smoke filter rods therefrom in a continuous manner according to the instant inventive concepts.

Referring now to FIGS. 2 and 3, preferred equipment used in making a bicomponent fiber according to the instant inventive concepts, and processing the same into filter rods that can be subsequently subdivided to form filter elements used in the production of filtered cigarettes or the like, is schematically illustrated. The overall processing line is designated generally by the reference numeral 20 in FIG. 2. In the embodiment shown, the bicomponent fibers themselves are made in-line with the equipment utilized to process the fibers into tobacco smoke filter rods. Such an arrangement is practical with the melt-blown techniques of this invention because of the small footprint of the equipment required for this procedure, although in-line processing is known as shown in '430 patent and is not critical to the instant inventive concepts. Thus, it is to be understood that bicomponent fibers according to this invention may be separately made and stored for extended periods of time before being formed into tobacco smoke filter rods as discussed below.

Whether in-line or separate, the bicomponent fibers themselves can be made using standard fiber spinning techniques for forming bicomponent filaments as seen, for example, in Powell U.S. Pat. Nos. 3,176,345 or 3,192,562 or Hills U.S. Pat. No. 4,406,850. The subject matter of each of the foregoing patents is incorporated herein in its entirety by reference for exemplary information regarding common techniques for the production of bicomponent fibers, including sheath-core fibers. Likewise, methods and apparatus for melt-blowing of fibrous materials, whether they are bicomponent or not, are well known. For example, reference is made to Buntin U.S. Pat. Nos. 3,595,245; 3,615,995 and 3,972,759, Schwarz U.S. Pat. Nos. 4,380,570 and 4,731,215, and Lohkamp et al U.S. Pat. No. 3,825,379. The melt-blowing of bicomponent fibers is shown in Krueger U.S. Pat. No. 5 4,795,688 and the aforementioned '430 patent. The entire subject matter of the foregoing patents is incorporated herein by reference for further background in this technology. These references are to be considered illustrative of well known techniques and apparatus for forming bicomponent fibers and melt-blowing for attenuation that may be used according to the instant inventive concepts and are not to be interpreted as limiting thereon.

In any event, one form of a sheath-core melt-blown die is shown enlarged in FIG. 2 at 25. Molten sheath-forming blended polymer according to this invention 26, and molten core-forming polymer 28 are fed into the die 25 and extruded therefrom through a pack of polymer distribution plates shown schematically 30 which may be of the type shown in the aforementioned '850 patent to Hills. Bicomponent fibers according to this invention need not be melt-blown. Such fibers could be collected in web form using techniques commonly referred to as "spun-bonded" or "spun-laced" (not shown). However, using melt-blown techniques which extrude the molten fibers into a high velocity airstream such as provided through an air plate shown schematically at 32, attenuates and solidifies the fibers, enabling the production of ultrafine bicomponent fibers as discussed above. Such treatment produces a randomly dispersed and tangled web or roving 34 (see FIG. 3) of the bicomponent fibers which is a form suitable for immediate processing without subsequent attenuation or crimp-inducing processing.

As schematically illustrated at 36, either particulate additives, such as granular activated charcoal, or even liquid flavorents such as menthol, may be deposited or sprayed onto the tow 34 of bicomponent fibers, if desired. A screen covered vacuum collection drum as shown schematically at 38 or similar device, may be used to separate the fibrous web or roving 34 from entrained air to facilitate further processing.

The remainder of the processing line seen in FIG. 3 is conventional and is shown and described in further detail in patents issued to the inventor hereof, Richard M. Berger. Exemplary Berger patents include U.S. Pat. Nos. 4,869,275; 4,355,995; and 3,637,447, the subject matter of each of which is incorporated herein in its entirety by reference.

In FIG. 3, the web or roving 34 of bicomponent fibers is produced using melt-blowing techniques as described with reference to FIG. 2, and continuously passed through a conventional air jet at 40, bloomed as seen at 42, and gathered into a rod shape in a heated air or steam die 44 where the sheath material is rendered bondable. By incorporating the core-forming material, e.g., polypropylene, in the polymeric blend forming the sheath, problems experienced in a buildup of sheath-forming material in the steam die 44 have been obviated.

The resultant material is cooled by air or the like in the die 46 to produce a relatively stable and self-sustaining rod-like fiber structure 48. The fiber rod 48 can be wrapped with paper or the like 50 (plug wrap) in a conventional manner to produce a continuously wrapped fiber rod 52. The continuously produced fiber rod 52, whether wrapped or not, may be passed through a standard cutter head 54 at which point it is cut into preselected tobacco filter rod lengths and deposited into an automatic packaging machine (not shown).

Figure 4:
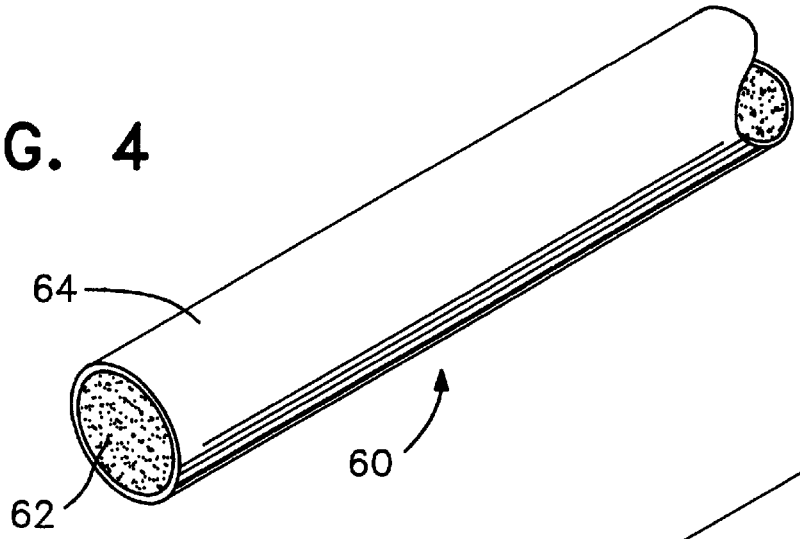
FIG. 4 is an enlarged perspective view of a portion of a tobacco smoke filter element produced from bicomponent fibers according to the instant inventive concepts.

By subdividing the resultant filter rods in any well known manner, a multiplicity of discrete tobacco filter elements or plugs according to this invention are formed, portions of one of which are illustrated schematically in FIG. 4 at 60. Each filter element 60 comprises an elongated air-permeable body of tobacco smoke filter material 62 encased in plug wrap 64. The filter material 62, according to this invention, is comprised of a multiplicity of bicomponent fibers such as shown at 10 in FIG. 1, bonded at their contact points to define a tortuous interstitial path for passage of tobacco smoke in use.

It is to be understood that the filter rods produced in accordance with this invention need not be of uniform construction throughout as illustrated herein, but could have interior pockets, exterior grooves, crimped portions or other modifications as shown in the aforementioned prior patents to Berger or others, without departing from the instant inventive concepts.

Figure 5:
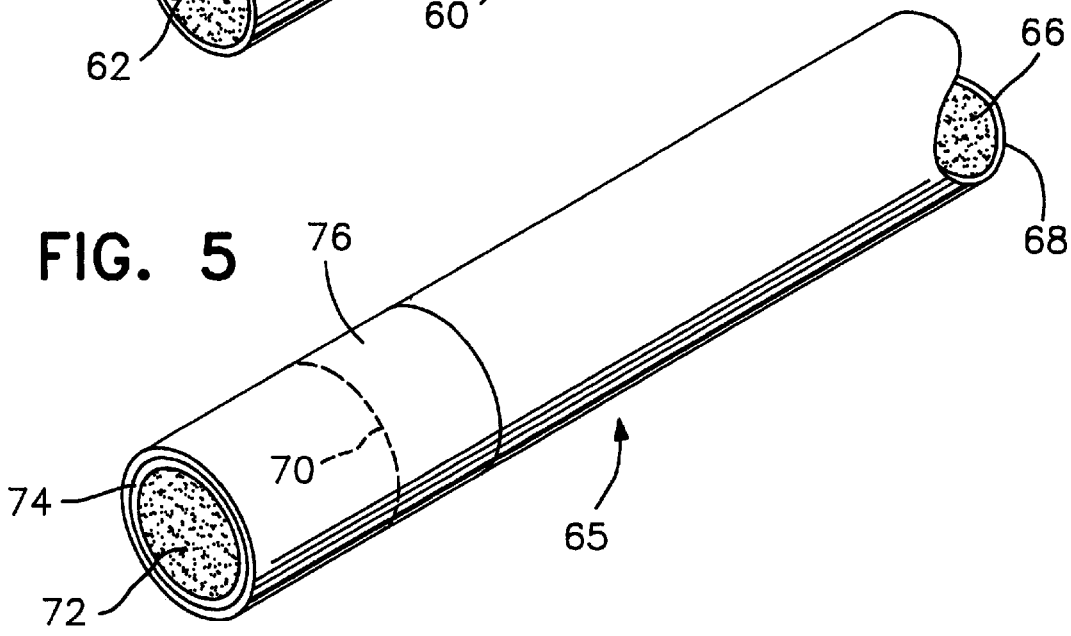
FIG. 5 is an enlarged perspective view of a cigarette including a filter element according to this invention.

Portions of a conventional filtered cigarette are illustrated schematically at 65 in FIG. 5 as comprising a tobacco rod 66 covered by a conventional cigarette paper 68 and secured to a filter means comprising a discrete filter element 70, such as would result in further subdividing a filter rod on conventional cigarette manufacturing equipment (not shown). The filter element 70 comprises a body of filtering material 72 over-wrapped by plug wrap 74 and secured to the tobacco rod in a conventional manner as by standard tipping wrap 76.

The key to the instant invention is the use of a blended sheath-forming material in the production of the bicomponent fibers, i.e., one that incorporates an ethylene-vinyl acetate copolymer in admixture with polypropylene in a ratio that satisfies all of the commercially important properties when used to form a tobacco smoke filter, while improving the hardness and avoiding processing problems caused by polymer build-up in the forming dies. While higher concentrations of ethylene-vinyl acetate in the sheath produce better taste, it has been found that satisfactory taste results when the bicomponent fiber sheath material includes as little as at least about 5.6% by weight of ethylene-vinyl acetate. This is preferably obtained by blending 20% by weight of an ethylene-vinyl acetate copolymer having 28% by weight of ethylene-vinyl acetate in the copolymer, with 80% by weight of polypropylene to form the sheath-forming material, and extruding such blend over a core of polypropylene. Other ethylene-vinyl acetate copolymer blends may be used to provide similar minimum levels of ethylene-vinyl acetate in the sheath; for example, substantially the same level of ethylene-vinyl acetate can be provided by using approximately 30% of a copolymer having 18% ethylene-vinyl acetate, admixed with 70% by weight of polypropylene in the sheath-forming material.

In order to overcome the die-sticking problems experienced in producing tobacco smoke filter elements from bicomponent fibers wherein the sheath is comprised essentially of all ethylene-vinyl acetate copolymer, it has been found that at least 36% by weight of the polymer of the core, that is, polypropylene, must be blended with the ethylene-vinyl acetate copolymer in the sheath-forming material. Thus, regardless of the level of ethylene-vinyl acetate in the copolymer, there should be no more than about 64% by weight of ethylene-vinyl acetate copolymer in the sheath to avoid a build-up of sheath-forming polymer in the steam heating and air cooling dies. This composition enables the production of tobacco smoke filters from bicomponent fibers including ethylene-vinyl acetate in the sheath, at a high speed consistent with the commercial application of this technology in the manufacture of filtered cigarettes and the like incorporating such filters.

In addition to avoiding the die-sticking problem experienced in the production of tobacco smoke filter rods from bi-component fibers having a core of polypropylene and a sheath formed entirely of ethylene-vinyl acetate copolymer, the incorporation of polypropylene into the sheath-forming material according to this invention has enabled the production of tobacco smoke filter elements of improved hardness, consistent with taste and other commercially important properties, e.g., pressure drop, filtration efficiency, manufacturing ease and speed, etc.

The examples set forth in the following tables provide further information regarding the instant inventive concepts. It is to be understood, however, that these examples are illustrative and the various materials and processing parameters may be modified within the skill of the art without departing from this invention.

Table 1 compares the retention levels and hardness of tobacco smoke filter element formed of bicomponent fibers comprises a polypropylene core and varying levels of ethylene-vinyl acetate in a blended ethylene-vinyl acetate/polypropylene sheath.

Figure 6:
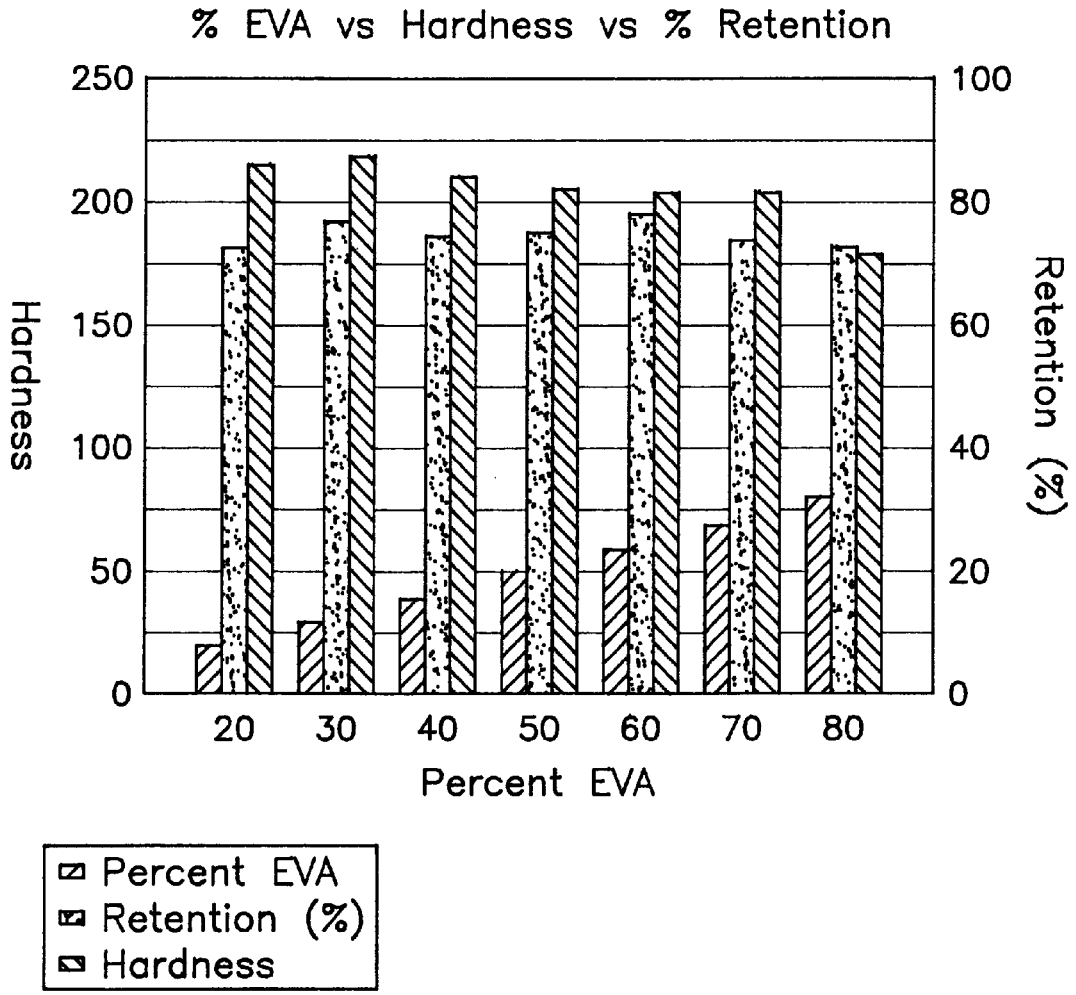
FIG. 6 is a bar graph comparing retention levels and hardness of tobacco smoke element including different levels of ethylene-vinyl acetate copolymer in the sheath.

FIG. 6 graphically illustrates selective date from Table 1.

To better explain the composition of fibers in the above table, reference is made to Example 1 wherein the fiber is comprised of 70% core and 30% sheath by weight. The core is made of 100% polypropylene; the sheath is a combination of 20% ethylene-vinyl acetate copolymer and 80% polypropylene. The ethylene-vinyl acetate copolymer used in this test is 28% ethylene-vinyl acetate and 72% ethylene. The percent ethylene-vinyl acetate in the sheath is then 5.6%. The previous samples made with 100% ethylene-vinyl acetate copolymer sheath as referenced in Example 8, had an ethylene-vinyl acetate content of 18%.

The taste of cigarettes incorporating filters having the characteristics of each of the examples in Table 1 was acceptable, including Example 1 having only 5.6% ethylene-vinyl acetate in the sheath. While the taste improved with higher ethylene-vinyl acetate levels, the production of filters wherein the sheath included less than about 36% by weight of polypropylene (i.e., Examples 6–8) encountered unacceptable processing difficulties in the nature of polymer build-up in the forming dies.

The filters of Examples 1–5 also meet other commercially important properties including pressure drop, retention and hardness, with the hardness being significantly improved as compared to Example 8 which incorporated no polypropylene in the sheath.

Table 2 illustrates the production of tobacco smoke filters utilizing finer bicomponent fibers than the products of Table 1, as evidenced by the presence of comparable pressure drops with lower fiber weight.

TABLE 1

| Example | 10 Wt. (g/10[1]) | Fiber Wt. (g/10)[2] | % EVA Copolymer[3] | % EVA[4] | % PP[5] | % Sheath[6] | Rod PD[7] | Retention (%)[8] | Hardness |
|---|---|---|---|---|---|---|---|---|---|
| 1 | 8.27 | 7.52 | 20 | 5.6 | 80 | 30 | 15.75 | 72.84 | 215.10 |
| 2 | 8.3 | 7.55 | 30 | 8.4 | 70 | 30 | 15.55 | 71.99 | 218.8 |
| 3 | 8.26 | 7.51 | 40 | 11.2 | 60 | 30 | 16.01 | 75 | 211 |
| 4 | 8.32 | 7.57 | 50 | 14.0 | 50 | 30 | 15.56 | 75.52 | 205.8 |
| 5 | 8.32 | 7.57 | 60 | 16.8 | 40 | 30 | 15.42 | 78.46 | 204.20 |
| 6 | 8.31 | 7.56 | 70 | 19.6 | 30 | 30 | 15.27 | 74.17 | 196.20 |
| 7 | 8.23 | 7.48 | 80 | 22.4 | 20 | 30 | 15.38 | 72.91 | 180.20 |
| 8 | 8.25 | 7.50 | 100 | 18.0 | 0 | 30 | 16.30 | 73.58 | 183.60 |

[1]The weight in grams of 10 wrapped filter rods, each of which equal 4 filter plugs.
[2]Same as [1] less the weight of the plug wrap.
[3]Percent by weight of ethylene-vinyl acetate copolymer in the sheath.
[4]Percent by weight of ethylene-vinyl acetate in the sheath.
[5]Percent by weight of polypropylene in the sheath.
[6]Percent by weight of sheath in the fiber.
[7]Rod pressure drop.
[8]Percent retention of total particulate matter in 27 mm filter.

TABLE 2

| Example | 10 Wt. (g/10) | Fiber Wt. (g/10) | % EVA Copolymer | % EVA | % PP | % Sheath | Rod PD | Retention (%) | Hardness |
|---|---|---|---|---|---|---|---|---|---|
| 9 | 7.31 | 6.55 | 30 | 8.4 | 60 | 40 | 16 | 79.81 | 181.1 |
| 10 | 7.35 | 6.6 | 50 | 14.0 | 50 | 30 | 15.76 | 78.99 | 161.7 |
| 11 | 7.32 | 6.57 | 100 | 28.0 | 0 | 30 | 15.38 | 74.36 | 130.7 |

It is to be noted, particularly from Example 11 that tobacco smoke filters including 100 percent of a 28% ethylene-vinyl acetate copolymer as compared to the 18% ethylene-vinyl acetate copolymer used in Example 8 of Table 1, have a dramatically reduced hardness, below commercially acceptable levels.

By comparing Example 9 with Example 2 and Example 10 with Example 4, each of which contain the same level of ethylene-vinyl acetate in the sheath, it is noted that retention levels are inversely proportional to fiber size, as would be expected because of the increased surface area. However, hardness dropped significantly. With respect to Example 9, this is partially attributable to the fact that this sample included 40% sheath as compared to the 30% sheath material in Example 2, the reduced level of core material rendering the product less firm.

To further consider the limiting nature of fiber size on hardness, a series of test products were produced with bicomponent fibers containing varying percentages of ethylene-vinyl acetate in the sheath and fibers of differing average diameter. Table 3 shows the minimum fiber size necessary at particular levels of ethylene-vinyl acetate to reach a hardness considered commercially acceptable.

TABLE 3

| Example | % EVA Copolymer | % EVA | % PP | Retention % | Fiber Size (Microns) |
|---|---|---|---|---|---|
| 12 | 20 | 5.6 | 80 | 77.7 | 4.5 |
| 13 | 30 | 8.4 | 70 | 77.9 | 4.0 |
| 14 | 40 | 11.2 | 60 | 78.8 | 3.5 |
| 15 | 50 | 14 | 50 | 82.0 | 3.0 |
| 16 | 60 | 16.8 | 40 | 79.4 | 4.1 |
| 17 | 100 | 18 | 0 | 74.6 | 6.0 |

With a sheath formed entirely of an 18% ethylene-vinyl acetate copolymer (Example 17) bicomponent fibers less than about 6 microns in average diameter produced unacceptably soft tobacco smoke filters. In contrast, using a 28% ethylene-vinyl acetate copolymer blended with from 40–60% polypropylene (Examples 12–16), finer fibers could be utilized, resulting in higher retention levels. Example 15 shows that with a 50:50 blend, fibers as low as 3 microns in average diameter could be effectively formed into tobacco smoke filter elements having an acceptable hardness. Such filters provide a retention level over 80%, approximately 10% higher than could be realized with filters formed from bicomponent fibers with 100% ethylene-vinyl acetate sheath/polypropylene core bicomponent fibers according to the '430 patent.

The foregoing description and the Examples in the Tables show various advantages resulting from incorporating polypropylene into the sheath-forming material of ethylene-vinyl acetate containing bicomponent fibers utilized to produce tobacco smoke filter elements for filtered cigarettes or the like.

Having described the invention, many modifications thereto will become apparent to those skilled in the art to which it pertains without deviation from the spirit of the invention as defined by the scope of the appended claims.

What is claimed is:

1. A tobacco smoke filter element comprising a substantially self-sustaining, substantially cylindrical element of fibrous material comprising continuous fibers bonded to each other at spaced points of contact to define a tortuous interstitial path for passage of smoke therethrough, at least a major part of said fibers being continuous bicomponent fibers comprising a core of a thermoplastic polymer substantially totally surrounded by a sheath of a blended polymer, wherein said sheath includes at least about 5.6 weight percent of ethylene-vinyl acetate and at least about 36 weight percent of said thermoplastic polymer forming said core.

2. The filter element of claim 1 wherein said thermoplastic polymer is selected from the group consisting of polypropylene and polyethylene.

3. The filter element of claim 1 wherein said core is formed of polypropylene and said sheath is a blend of an ethylene-vinyl acetate copolymer and polypropylene.

4. The filter element of claim 3 wherein said ethylene-vinyl acetate copolymer comprises approximately 28% by weight ethylene-vinyl acetate.

5. The filter element of claim 4 wherein said sheath comprises a blend of about 20% by weight of an ethylene-vinyl acetate copolymer including about 28% by weight of ethylene-vinyl acetate, and about 80% by weight of polypropylene.

6. The filter element of claim 4 wherein said sheath comprises a blend of about 50% by weight of said ethylene-vinyl acetate copolymer and about 50% by weight of polypropylene.

7. The filter element of claim 1 wherein said sheath comprises at least about 30% by weight of said fiber.

8. The filter element of claim 1 wherein said core comprises at least about 50% by weight of said fiber.

9. The filter element of claim 8 wherein said fibers, on average, are at least 3 microns in diameter.

10. The filter element of claim 9 wherein said fibers, on average, are less than 6 microns in diameter.

11. A filter rod comprising a multiplicity of filter elements according to claim 1 integrally connected to each other in end-to-end relationship.

12. A cigarette comprising a tobacco portion and a filter portion, said filter portion including at least one filter element comprising a substantially self-sustaining, substantially cylindrical element of fibrous material comprising continuous fibers bonded to each other at spaced points of contact to define a tortuous interstitial path for passage of smoke therethrough, at least a major part of said fibers being continuous bicomponent fibers comprising a core of thermoplastic polymer substantially totally surrounded by a sheath of a blended polymer, wherein said sheath includes at least 5.6 weight percent of ethylene-vinyl acetate and at least about 36 weight percent of said thermoplastic polymer forming said core.

13. The cigarette of claim 12 wherein said thermoplastic polymer is selected from the group consisting of polypropylene and polyethylene.

14. The cigarette of claim 12 wherein said core is formed of polypropylene and said sheath is a blend of an ethylene-vinyl acetate copolymer and polypropylene.

15. The cigarette of claim 14 wherein said ethylene-vinyl acetate copolymer comprises approximately 28% by weight ethylene-vinyl acetate.

16. The cigarette of claim 15 wherein said sheath comprises a blend of about 20% by weight of an ethylene-vinyl acetate copolymer including about 28% by weight of ethylene-vinyl acetate, and about 80% by weight of polypropylene.

17. The cigarette of claim 15 wherein said sheath comprises a blend of about 50% by weight of said ethylene-vinyl acetate copolymer and about 50% by weight of polypropylene.

18. The cigarette of claim 12 wherein said sheath comprises at least about 30% by weight of said fiber.

19. The cigarette of claim 12 wherein said core comprises at least about 50% by weight of said fiber.

20. The cigarette of claim 19 wherein said fibers, on average are at least 3 microns in diameter.

21. The cigarette of claim 20 wherein said fibers, on average, are less than 6 microns in diameter.

* * * * *

UNITED STATES PATENT AND TRADEMARK OFFICE

CERTIFICATE OF CORRECTION

PATENT NO. : 6,026,819
DATED : February 22, 2000
INVENTOR(S) : Richard M. Berger It is certified that error appears in the above-identified patent and that said Letters Patent is hereby corrected as shown below:

Column 4,
Lines 54-55, change "ethylene-vinyl acetate" to -- vinly acetate --.

Column 5,
Lines 2, 6, 7, 8 and 10-11, change "ethylene-vinyl acetate" to -- vinyl acetate --.

Column 8,
Lines 54, 57-58, 60, 64-65 and 66, change "ethylene-vinyl acetate" to -- vinyl acetate --;
Line 67, delete "ethylene-".

Column 10,
Line 10, change "ethylene-vinyl acetate" to -- vinyl acetate --;
Table 1, column 5 of heading, change "EVA" to -- VA --;
footnote 4, change "ethylene-vinyl acetate" to -- vinyl acetate --.

Column 10,
Line 10 (after "28%), change "ethylene-vinyl acetate" to -- vinyl acetate --;
Line 11 (after "percent"), change "ethylene-vinyl" to -- vinyl --;
Lines 17 (after "had an") and 22-23 (after "5.6%"), change "ethylene-vinyl acetate" to -- vinyl acetate --.

Column 11,
Table 2, column 5 of heading, change "EVA" to -- VA --;
Lines 13, 14, 19, 30 and 32, change "ethylene-vinyl acetate" to -- vinyl acetate --;
Table 3, column 3 of heading, change "EVA" to -- VA --;
Lines 45-46 and 49, change "ethylene-vinyl acetate" to -- vinyl acetate --.

UNITED STATES PATENT AND TRADEMARK OFFICE

CERTIFICATE OF CORRECTION

PATENT NO. : 6,026,819
DATED : February 22, 2000
INVENTOR(S) : Richard M. Berger It is certified that error appears in the above-identified patent and that said Letters Patent is hereby corrected as shown below:

Column 12,
Lines 23, 34, 38 and 65, change "ethylene-vinyl acetate" to -- vinyl acetate --.

Column 13,
Lines 9 and 13, change "ethylene-vinyl acetate" to -- vinyl acetate --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,026,819
DATED : February 22, 2000
INVENTOR(S) : Richard M. Berger It is certified that error appears in the above-identified patent and that said Letters Patent is hereby corrected as shown below:

Column 4,
Lines 54-55, change "ethylene-vinyl acetate" to -- vinyl acetate --.

Column 5,
Lines 2, 6, 7, 8 and 10-11, change "ethylene-vinyl acetate" to -- vinyl acetate --.

Column 8,
Lines 54, 57-58, 60, 64-65 and 66, change "ethylene-vinyl acetate" to -- vinyl acetate --;
Line 67, delete "ethylene-".

Column 10,
Line 10, change "ethylene-vinyl acetate" to -- vinyl acetate --;
Table 1, column 5 of heading, change "EVA" to -- VA --;
footnote 4, change "ethylene-vinyl acetate" to -- vinyl acetate --.

Column 10,
Line 10 (after "28%), change "ethylene-vinyl acetate" to -- vinyl acetate --;
Line 11 (after "percent"), change "ethylene-vinyl" to -- vinyl --;
Lines 17 (after "had an") and 22-23 (after "5.6%"), change "ethylene-vinyl acetate" to -- vinyl acetate --.

Column 11,
Table 2, column 5 of heading, change "EVA" to -- VA --;
Lines 13, 14, 19, 30 and 32, change "ethylene-vinyl acetate" to -- vinyl acetate --;
Table 3, column 3 of heading, change "EVA" to -- VA --;
Lines 45-46 and 49, change "ethylene-vinyl acetate" to -- vinyl acetate --.

UNITED STATES PATENT AND TRADEMARK OFFICE

CERTIFICATE OF CORRECTION

PATENT NO. : 6,026,819
DATED : February 22, 2000
INVENTOR(S) : Richard M. Berger It is certified that error appears in the above-identified patent and that said Letters Patent is hereby corrected as shown below:

Column 12,
Lines 23, 34, 38 and 65, change "ethylene-vinyl acetate" to -- vinyl acetate --.

Column 13,
Lines 9 and 13, change "ethylene-vinyl acetate" to -- vinyl acetate --.

This Certificate supercedes Certificate of Correction issued August 21, 2001.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*